US011009272B2

(12) United States Patent
Reardon et al.

(10) Patent No.: US 11,009,272 B2
(45) Date of Patent: May 18, 2021

(54) LOW AMBIENT OPERATION OF HVAC SYSTEM

(71) Applicant: Johnson Controls Technology Company, Auburn Hills, MI (US)

(72) Inventors: Anthony J. Reardon, Moore, OK (US); Zhiwei Huang, Moore, OK (US)

(73) Assignee: Johnson Controls Technology Company, Auburn Hills, MI (US)

( * ) Notice: Subject to any disclaimer, the term of this patent is extended or adjusted under 35 U.S.C. 154(b) by 80 days.

(21) Appl. No.: 16/274,057

(22) Filed: Feb. 12, 2019

(65) Prior Publication Data

US 2020/0240684 A1 Jul. 30, 2020

Related U.S. Application Data

(60) Provisional application No. 62/797,848, filed on Jan. 28, 2019.

(51) Int. Cl.

| | |
|---|---|
| ***F25B 39/04*** | (2006.01) |
| ***F28F 9/26*** | (2006.01) |
| ***F25B 49/02*** | (2006.01) |
| ***F24F 11/74*** | (2018.01) |
| ***F04D 27/00*** | (2006.01) |

(52) U.S. Cl.

CPC ..... *F25B 39/04* (2013.01); *F04D 27/004* (2013.01); *F24F 11/74* (2018.01); *F25B 49/027* (2013.01); *F28F 9/26* (2013.01)

(58) Field of Classification Search

CPC ..... F25B 39/04; F25B 49/027; F25B 6/02; F25B 2600/25; F25B 2600/2519; F25B 2700/193; F25B 2700/1931; F25B 2700/195; F25B 41/04; F25B 2500/31; F28D 1/05391; F28D 1/0417; F28D 1/0408; F28D 1/0443; F28F 9/26

See application file for complete search history.

(56) References Cited

U.S. PATENT DOCUMENTS 3,481,152 A * 12/1969 Seeley ..... F25B 49/027 62/196.4
5,138,844 A * 8/1992 Clanin ..... F25B 49/027 62/180
5,533,259 A * 7/1996 Hughes ..... F25B 39/02 29/890.043
6,955,057 B2 10/2005 Taras et al.
(Continued)

*Primary Examiner* — Joseph F Trpisovsky
(74) *Attorney, Agent, or Firm* — Fletcher Yoder, P.C.

(57) ABSTRACT

A heating, ventilation, and/or air conditioning (HVAC) system has a refrigerant circuit that includes a compressor, a condenser system with a first set of tubes and a second set of tubes fluidly separate from the first set of tubes within the condenser system, and a valve positioned downstream of the compressor and upstream of the second set of tubes relative to a direction of refrigerant flow through the refrigerant circuit, in which the refrigerant circuit is configured to direct refrigerant through the first set of tubes and through the second set of tubes. The HVAC system further has a switch configured to detect an operating parameter and to instruct the valve to close based on the operating parameter such that refrigerant flow is blocked through the second set of tubes and refrigerant flow is enabled through the first set of tubes.

25 Claims, 8 Drawing Sheets

(56) References Cited

U.S. PATENT DOCUMENTS

| | | | | |
|---|---|---|---|---|
| 7,263,852 | B2 * | 9/2007 | Bacchus | F25B 39/04 62/305 |
| 8,683,817 | B2 | 4/2014 | Fraser | |
| 9,086,232 | B1 | 7/2015 | Read | |
| 2006/0288713 | A1 * | 12/2006 | Knight | F25B 49/027 62/176.6 |
| 2012/0111030 | A1 * | 5/2012 | Fraser | F25B 49/027 62/56 |
| 2016/0161163 | A1 * | 6/2016 | Hung | F25B 13/00 62/205 |
| 2019/0048873 | A1 * | 2/2019 | Lee | F04C 18/16 |

* cited by examiner

LOW AMBIENT OPERATION OF HVAC SYSTEM

CROSS REFERENCE TO RELATED APPLICATIONS

This application claims priority from and the benefit of U.S. Provisional Application Ser. No. 62/797,848, entitled "LOW AMBIENT OPERATION OF HVAC SYSTEM", filed Jan. 28, 2019, which is hereby incorporated by reference in its entirety for all purposes.

BACKGROUND

The disclosure relates generally to heating, ventilation, and/or air conditioning (HVAC) systems, and specifically, relates to operating modes of a heat exchanger in an HVAC system.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Environmental control systems are utilized in residential, commercial, and industrial environments to control environmental properties, such as temperature and humidity, for occupants of the respective environments. The environmental control system may control the environmental properties by conditioning and delivering an air flow delivered to the environment. For example, a heating, ventilation, and air conditioning (HVAC) system may use a heat exchanger to place the air flow in thermal communication with a refrigerant directed through the heat exchanger. The HVAC system may be configured to operate in different operating modes to maintain a desired performance, such as an efficiency to condition the air flow, of the HVAC system. However, implementation of different operating modes may be costly.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a heating, ventilation, and/or air conditioning (HVAC) system has a refrigerant circuit that includes a compressor, a condenser system with a first set of tubes and a second set of tubes fluidly separate from the first set of tubes within the condenser system, and a valve positioned downstream of the compressor and upstream of the second set of tubes relative to a direction of refrigerant flow through the refrigerant circuit, in which the refrigerant circuit is configured to direct refrigerant through the first set of tubes and through the second set of tubes. The HVAC system further has a pressure switch configured to detect a discharge pressure of the compressor and to instruct the valve to close based on the discharge pressure being below a threshold pressure, such that refrigerant flow is blocked through the second set of tubes and refrigerant flow is enabled through the first set of tubes.

In another embodiment, a heating, ventilation, and/or air conditioning (HVAC) system has a condenser system having a first set of tubes and a second set of tubes, a valve positioned within the condenser system and upstream of the second set of tubes relative to a direction of refrigerant flow through the second set of tubes, and a pressure switch communicatively coupled to the valve. The first set of tubes and the second set of tubes are each configured to receive refrigerant. Furthermore, the pressure switch is configured to detect a discharge pressure of a compressor configured to drive the refrigerant flow through the condenser system, in which the pressure switch is configured to instruct the valve to close based on the discharge pressure being below a threshold pressure such that refrigerant flow is blocked through the second set of tubes and enabled through the first set of tubes.

In another embodiment, a heating, ventilation, and/or air conditioning (HVAC) system includes a condenser system having a first set of tubes and a second set of tubes, a switch configured to detect a compressor discharge pressure of the HVAC system, and a valve positioned upstream of the second set of tubes relative to a direction of refrigerant flow through the second set of tubes. The first set of tubes and the second set of tubes are each configured to receive refrigerant. Furthermore, the switch is configured to output a signal based on the compressor discharge pressure being above or below a threshold pressure, and the valve is configured to transition between an open position and a closed position based on the signal output by the switch.

DRAWINGS

Various aspects of this disclosure may be better understood upon reading the following detailed description and upon reference to the drawings in which.

DETAILED DESCRIPTION

Figure 1:
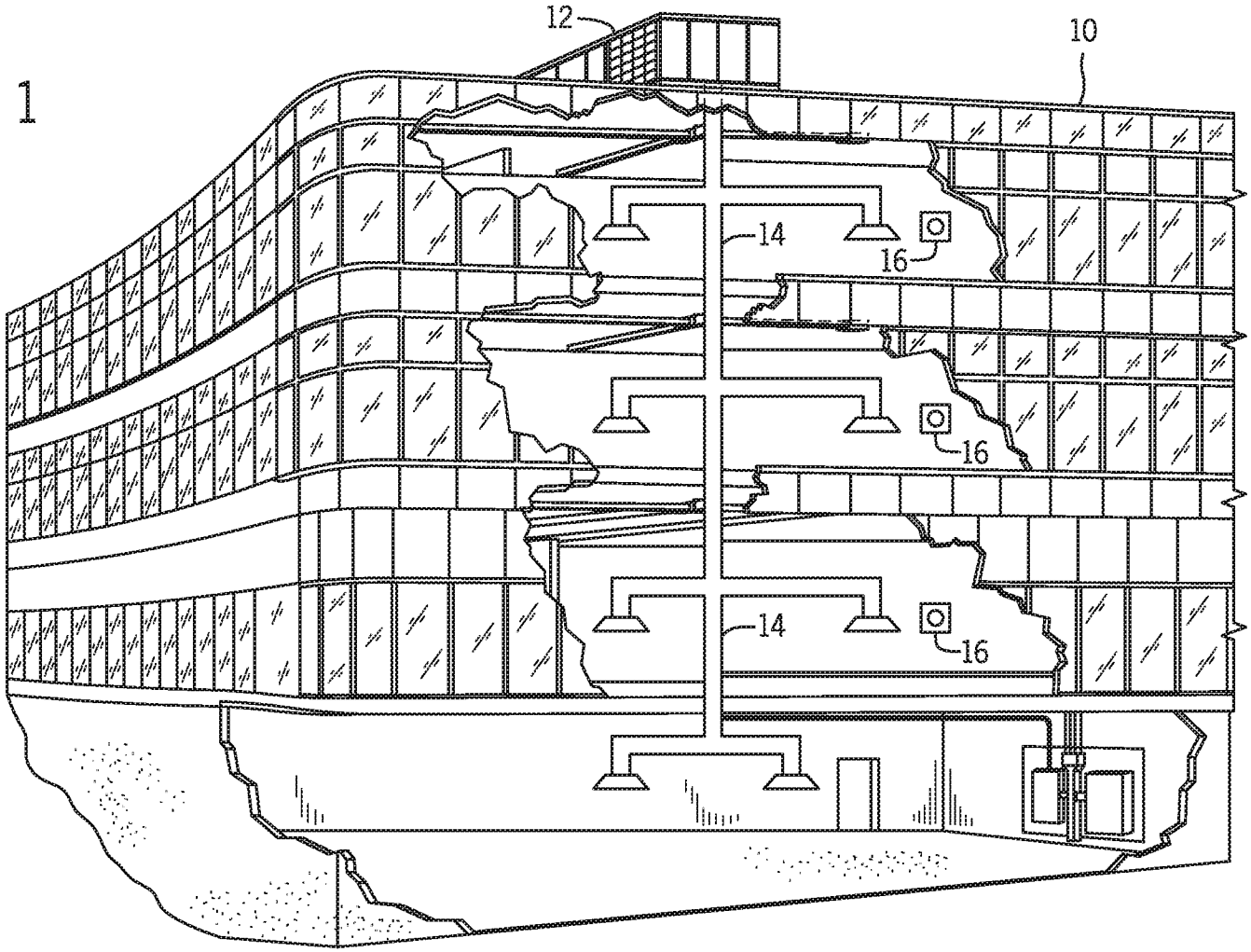
FIG. 1 is a perspective view of an embodiment of a building that may utilize a heating, ventilation, and/or air conditioning (HVAC) system in a commercial setting, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

The present disclosure is directed to a heating, ventilation, and/or air conditioning (HVAC) system that circulates a refrigerant through a refrigerant circuit having a heat exchanger of the HVAC system. For example, the refrigerant may be pressurized by a compressor of the refrigerant circuit and may then be discharged to a condenser of the refrigerant circuit, where the pressurized refrigerant is cooled and condensed, such as via heat exchange with an environmental air flow directed across the condenser. The cooled refrigerant may then be directed to an evaporator disposed along the refrigerant circuit to be placed in a heat exchange relationship with a supply air flow. Heat exchange between the supply air flow and the refrigerant within the evaporator causes the supply air flow to cool before the supply air flow is supplied to a space serviced by the HVAC system.

The compressor may pressurize the refrigerant to a discharge pressure that is above a pressure threshold in order to maintain a desired performance of the HVAC system. For example, pressurizing the refrigerant to a level below the pressure threshold may result in an undesirable flow of the refrigerant into the compressor, which may impact the ability of the HVAC system to efficiently and/or effectively cool the air flow. Generally, the temperature of a refrigerant is proportional to the pressure of the refrigerant. Thus, increasing the temperature of the refrigerant entering the compressor increases the discharge pressure of the refrigerant. In other words, pressurizing a refrigerant of a higher temperature achieves a higher discharge pressure relative to a refrigerant that is pressurized at a lower temperature. During certain operating conditions, such as when an ambient temperature is low, the temperature of the refrigerant may decrease via increased heat exchange with the low temperature environmental air flow directed across the condenser. As a result, the discharge pressure of the refrigerant may fall below the pressure threshold. In response, the HVAC system may adjust from a normal operating mode to a low ambient operating mode to effectuate an increase in the discharge pressure above the pressure threshold. To this end, cooling of the refrigerant in the condenser may be reduced in order to increase the temperature of the refrigerant exiting the condenser and thereby enable the refrigerant to be heated to a higher temperature in the evaporator. As such, the refrigerant enters the compressor at a higher temperature and will therefore be pressurized to an increased discharge pressure that is above the pressure threshold.

Accordingly, in the embodiments disclosed herein, in the low ambient operating mode of the HVAC system, the refrigerant may be directed through the condenser in a different manner, as compared to the normal operating mode, in order to reduce the cooling of the refrigerant in the condenser. For example, the refrigerant may be blocked from flowing through certain parts of the condenser. As discussed in detail below, reducing the sections of the condenser through which the refrigerant is directed reduces a rate of cooling of the refrigerant in the condenser. As a result, the refrigerant exits the condenser at a higher temperature, and the discharge pressure of the refrigerant is increased as a result. Furthermore, in the low ambient operating mode, the operation of other components of the HVAC system may be maintained or unmodified, thereby limiting a cost to operate the HVAC system. For example, the operation of the compressor and/or fans of the HVAC system may remain the same in the low ambient operating mode as compared to the normal operating mode, thereby limiting the complexity of the HVAC system, which may reduce costs of operating the HVAC system. In other words, implementation of the disclosed low ambient operating mode may be realized without the use of certain HVAC components, such as a compressor, evaporator, fan, motor, and so forth, which have multiple operating modes. As a result, the low ambient operating mode described herein may be implemented while also limiting the complexity of HVAC system operation and limiting costs associated with HVAC system manufacturing and operation.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
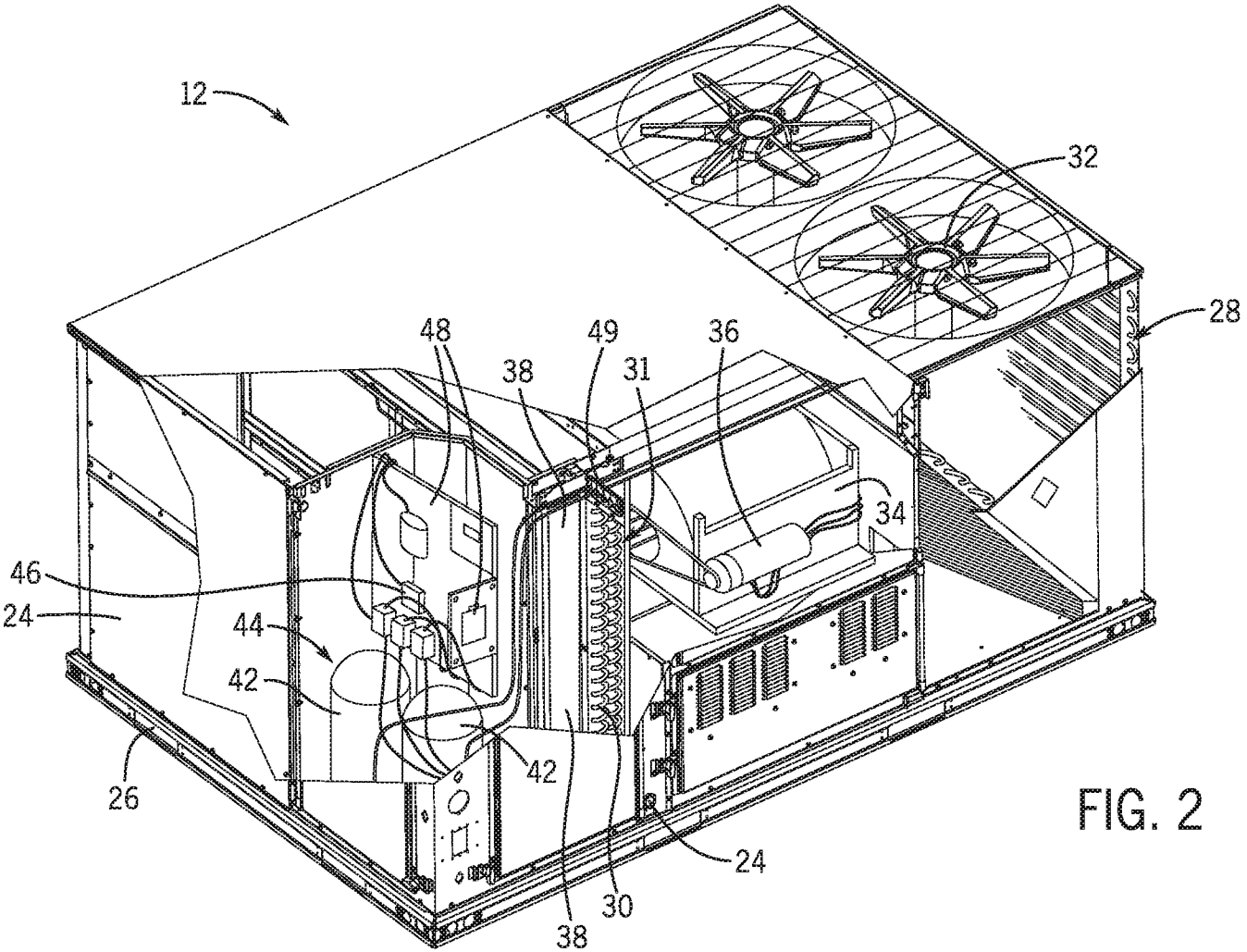
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
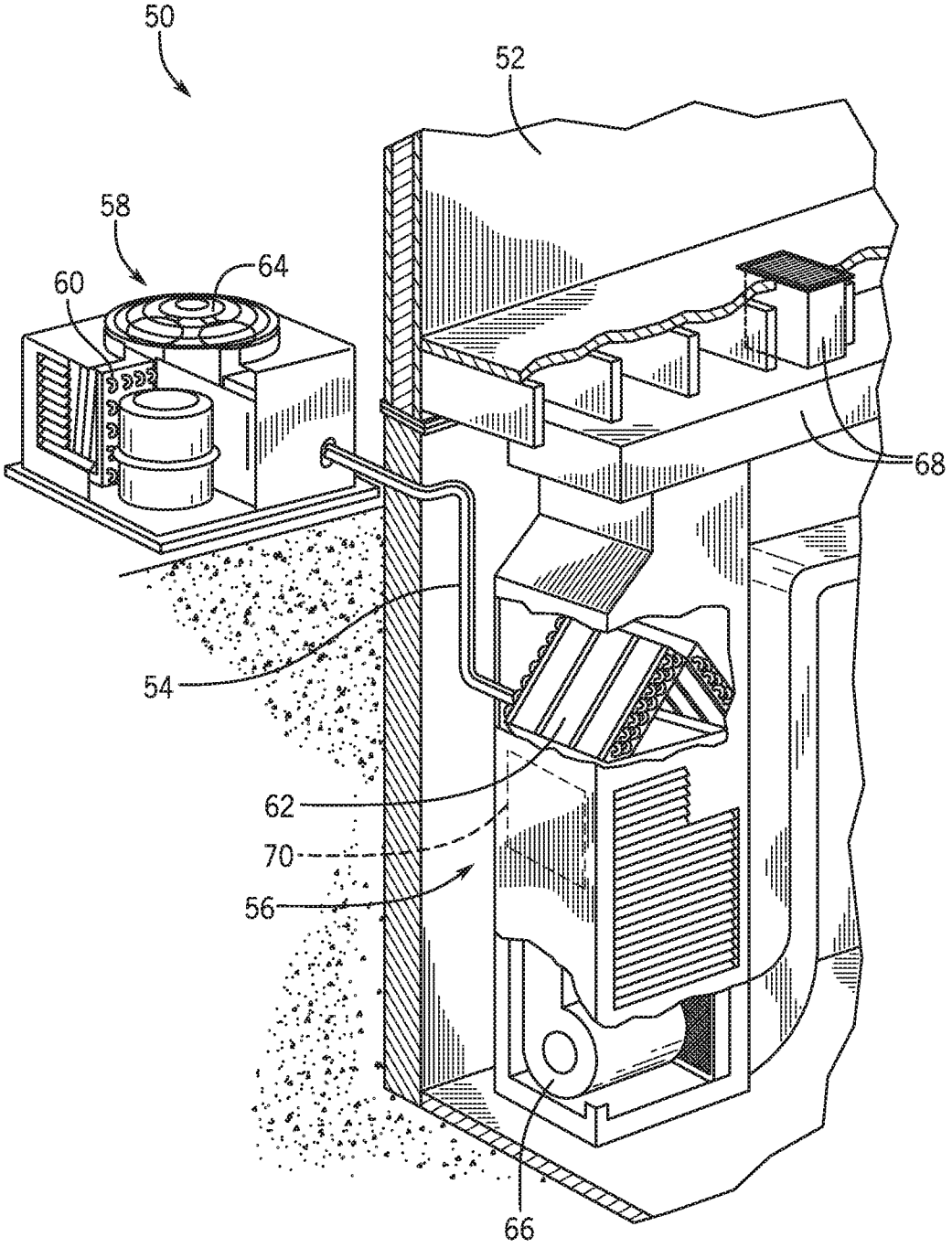
FIG. 3 is a schematic of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
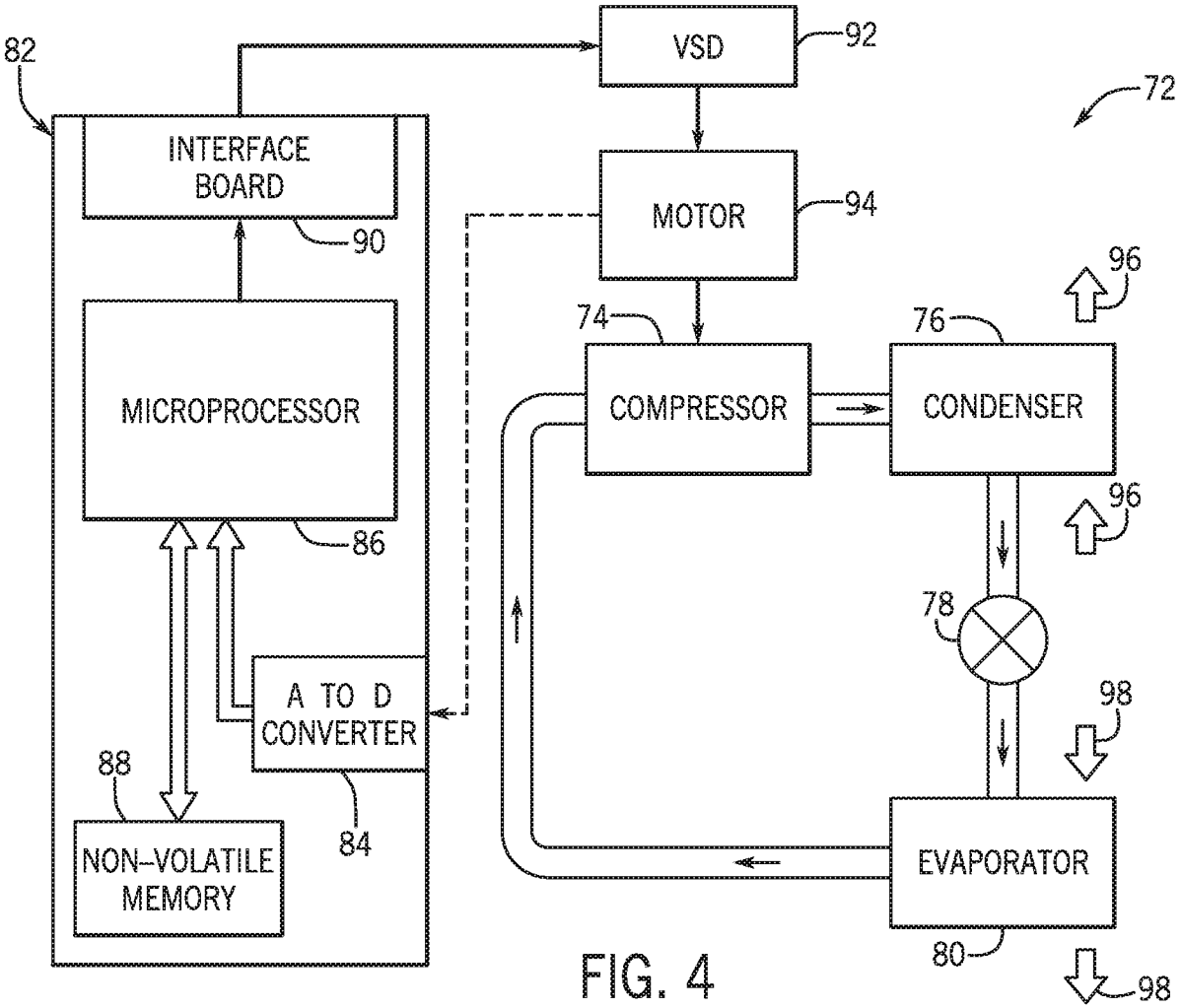
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

An HVAC system, such as the HVAC unit 12, may be configured to operate in a normal operating mode and a low ambient operating mode, in which the normal operating mode and the low ambient operating mode each maintains a compressor discharge pressure of the HVAC system above a pressure threshold. As discussed below, the operating mode may be selected based on various factors, such as a temperature of ambient environmental air that is directed across a heat exchanger of the HVAC system. In the normal operating mode, a refrigerant of the HVAC system may be directed through all sections of a heat exchanger, such as a condenser, configured to transfer heat between the refrigerant and an environmental air flow, such as outdoor air, directed across the heat exchanger. In some circumstances, the compressor discharge pressure of the HVAC system may decrease below the pressure threshold. Indeed, a decrease in the compressor discharge pressure may be attributable to increased heat exchange between the refrigerant and the environmental air flow directed across the condenser that is caused by a drop in the temperature of the environmental air flow. Accordingly, embodiments of the present disclosure include a low ambient operating mode that is utilized to increase the compressor discharge pressure above the pressure threshold when the environmental air flow temperature is low. During the low ambient operating mode, the operation of the HVAC system may be adjusted such that the refrigerant is directed through a reduced portion, instead of through all sections, of the heat exchanger in order to reduce the amount of heat transferred between the refrigerant and the environmental air flow. For example, the refrigerant may be blocked from flowing through a particular section of the heat exchanger in the low ambient operating mode. Reducing the amount of heat transferred between the refrigerant and the environmental air flow directed across the condenser may effectuate an increase in the compressor discharge pressure of the HVAC system without operational adjustment of other components of the HVAC system.

Figure 5:
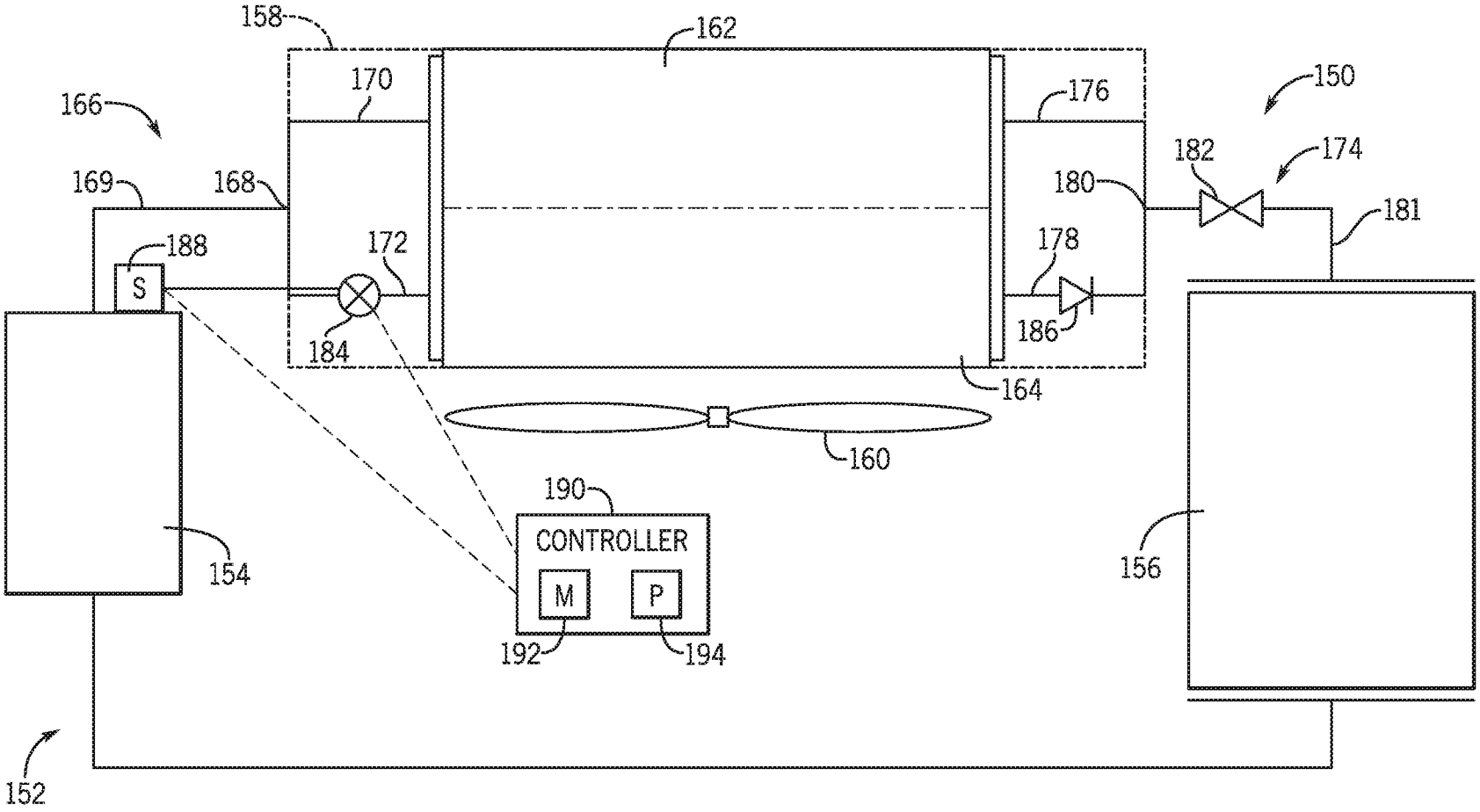
FIG. 5 is schematic view of an embodiment of an HVAC system configured to direct refrigerant through a refrigerant circuit, in accordance with an aspect of the present disclosure.

FIG. 5 is schematic view of an embodiment of an HVAC system 150 configured to direct refrigerant through a refrigerant circuit 152. The refrigerant circuit 152 may include a compressor 154 configured to pressurize the refrigerant flowing through the refrigerant circuit 152, an evaporator 156 configured to place the refrigerant in a heat exchange relationship with an air flow, such as a supply air flow, and a condenser system 158 configured to place the refrigerant in a heat exchange relationship with another air flow, such as an environmental or outdoor air flow. For example, the refrigerant may absorb heat from the supply air flow at the evaporator 156, thereby cooling the supply air flow and heating the refrigerant to vaporize at least a portion of the refrigerant. The heated and vaporized refrigerant may then be directed to the compressor 154 via the refrigerant circuit 152, and the compressor 154 pressurizes the refrigerant. The compressor 154 may then discharge the pressurized refrigerant to the condenser system 158, where the refrigerant may be cooled, such as via one or more fans 160 configured to direct the environmental or ambient air across the condenser system 158.

In some embodiments, the condenser system 158 includes a first set of tubes 162 and a second set of tubes 164 that are fluidly separate from one another within the condenser system 158. That is, within the condenser system 158, refrigerant may flow through the first set of tubes 162 or through the second set of tubes 164, but not through both the first set of tubes 162 and the second set of tubes 164. In additional or alternative embodiments, the condenser system 158 may include a microchannel heat exchanger, in which the refrigerant is directed through microchannels of the condenser system 158. In some implementations, the first set of tubes 162 may have a different number of tubes than the second set of tubes 164. For example, the first set of tubes 162 may include double the number of tubes as the second set of tubes 164. That is, the first set of tubes 162 may include two-thirds of a total number of tubes of the condenser system 158, and the second set of tubes 164 includes one-third of the total number of tubes of the condenser system 158. However, the first set of tubes 162 and the second set of tubes 164 may each include any suitable number of tubes as the second set of tubes 164 or may include any suitable fraction of a total number of tubes of the condenser system 158. As an example, the first set of tubes 162 may include 25 percent to 50 percent, 50 percent to 75 percent, or more than 75 percent of the total number of tubes of the condenser system 158. In additional or alternative embodiments, the first set of tubes 162 may be configured to direct a different volumetric flow rate of refrigerant than the second set of tubes 164. Moreover, although FIG. 5 indicates that the first set of tubes 162 and the second set of tubes 164 are disposed at separate locations or areas of the condenser system 158, in some embodiments, the first set of tubes 162 may be intertwined with the second set of tubes 164. In other words, the first set of tubes 162 and the second set of tubes 164 may extend adjacent to one another at different locations within the condenser system 158.

A first conduit system 166 of the refrigerant circuit 152 is configured to direct the refrigerant from the compressor 154 to the condenser system 158. As used herein, the first conduit system 166 extending between the compressor 154 and the condenser system 158 includes components, such as tubes, valves, and so forth, configured to regulate a flow of refrigerant from the compressor 154 to the condenser system 158. As illustrated, the first conduit system 166 includes a split 168 to divide a main inlet conduit 169 extending from the compressor 154 into a first inlet conduit 170 configured to direct refrigerant into the first set of tubes 162 and a second inlet conduit 172 configured to direct refrigerant into the second set of tubes 164. During operation of the HVAC system 150, the one or more fans 160 may be active to force or draw air, such as ambient environmental air, across both the first set of tubes 162 and the second set of tubes 164. In this way, heat may be transferred from the refrigerant flowing through the condenser system 158 to the ambient environmental air.

A second conduit system 174 may be configured to direct refrigerant from the condenser system 158 to the evaporator 156. The second conduit system 174 may include components, such as tubing, valves, and so forth, configured to regulate a flow of refrigerant from the condenser system 158 to the evaporator 156. The second conduit system 174 includes a first outlet conduit 176 configured to direct refrigerant out of the first set of tubes 162 and a second outlet conduit 178 configured to direct refrigerant out of the second set of tubes 164. The first outlet conduit 176 and the second outlet conduit 178 join at a conjunction 180 of the second conduit system 174. At the conjunction 180, the respective refrigerant flows of the first outlet conduit 176 and the second outlet conduit 178 combine and continue flowing through a main outlet conduit 181 towards the evaporator 156. In certain embodiments, the second conduit system 174 includes an expansion device 182 disposed along the main outlet conduit 181, which may be similar to the expansion device 78, that is configured to reduce a pressure of the refrigerant flowing into the evaporator 156. The decrease in pressure of the refrigerant may also further decrease a temperature of the refrigerant flowing into the evaporator 156.

In some instances, such as when ambient air is below a certain temperature, the discharge pressure of the refrigerant exiting the compressor 154, which may also be the discharge pressure of the compressor 154 or compressor discharge pressure of the HVAC system 150, may be below a desired threshold pressure. As such, in accordance with embodiments of the present disclosure, an operation of the HVAC system 150 may be adjusted to a low ambient operating mode in order to increase the discharge pressure of refrigerant exiting the compressor 154, such as by reducing the cooling of the refrigerant in the condenser system 158. For example, the refrigerant may be directed through a portion of the condenser system 158, rather than through all of the condenser system 158, such that heat may be removed from the refrigerant by the ambient air at a lower rate. Therefore, the refrigerant may enter the evaporator 156 at a higher temperature.

To regulate refrigerant flow through the condenser system 158, the HVAC system 150 may include a first valve 184 positioned along the second inlet conduit 172 and configured to regulate or block a flow of refrigerant through the second set of tubes 164. In the low ambient operating mode, refrigerant may flow through the first set of tubes 162, but the flow of refrigerant through the second set of tubes 164 may be blocked. In other words, in the low ambient operating mode, the first valve 184 may be actuated to block refrigerant flow through the second set of tubes 164 from the main inlet conduit 169. Additionally, in certain embodiments, the HVAC system 150 may include a second valve 186 disposed along the second outlet conduit 178 to block refrigerant flow from the second conduit system 174 into the second set of tubes 164. For example, the second valve 186 may be a check valve that enables refrigerant flow from the second set of tubes 164, through the second outlet conduit 178, and to the main outlet conduit 181, but blocks refrigerant flow from the first outlet conduit 176 or the main outlet conduit 181, through the second outlet conduit 178, and toward the second set of tubes 164. Although FIG. 5 illustrates the condenser system 158 as having the first set of tubes 162 and the second set of tubes 164, in alternative embodiments, the condenser system 158 may have any other suitable number of sets of tubes, and the HVAC system 150 may include suitable valves that enable control of refrigerant flow through each set of tubes.

In FIG. 5, the condenser system 158 is shown as including the split 168 of the first conduit system 166 and the conjunction 180 of the second conduit system 174, such that the first valve 184 and the second valve 186 may each be considered as part of the condenser system 158. In alternative embodiments, the first valve 184 and/or the second valve 178 may be considered to be positioned outside of the condenser system 158, such as adjacent to the compressor 154 or the evaporator 156, respectively. However, the first valve 184 and the second valve 178 may still control the flow of refrigerant through the HVAC system 150 in accordance with the techniques described herein. That is, regardless of whether the first valve 184 is considered to be a component of the condenser system 158, the first conduit system 166, or both, the first valve 184 is configured to block or regulate refrigerant flow through the second set of tubes 164 and does not block refrigerant flow through the first set of tubes 162. Similarly, regardless of whether the second valve 186 is considered to be a component of the condenser system 158, the second conduit system 174, or both, the second valve 186 is configured to block or regulate refrigerant flow through the second set of tubes 164 and does not block refrigerant flow through the first set of tubes 162.

In certain embodiments, the HVAC system 150 may include a switch 188 configured to measure, detect, and/or indicate an operating parameter of the HVAC system 150. As described herein, the switch 188 primarily detects a discharge pressure of refrigerant exiting the compressor 154. Thus, the switch 188 may be a pressure switch, a pressure transducer or sensor, or another suitable component configured to detect the discharge pressure of refrigerant exiting the compressor 154. However, in additional or alternative embodiments, the switch 188 may detect a temperature of the refrigerant, a pressure of the refrigerant elsewhere in the HVAC system 150, a temperature of ambient air exterior to the HVAC system 150, another suitable operating parameter, or any combination thereof. As such, the switch 188 may be another type of switch, transducer, sensor, or suitable component that detects the operating parameter of the HVAC system 150. The switch 188 may be located within the compressor 154, adjacent to the compressor 154, or may be considered to be a part of the first conduit system 166 and/or the condenser system 158. For example, in one embodiment, the switch 188 may be positioned adjacent to the split 168 of the first conduit system 166.

A position of the first valve 184 may be regulated based on a signal communicated by the switch 188. For example, the first valve 184 may transition between an open position, whereby the first valve 184 enables refrigerant flow through the second set of tubes 164, and a closed position, whereby the first valve 184 blocks refrigerant flow through the second set of tubes 164, based on the signal communicated by the switch 188. For example, the signal communicated by the switch 188 may be indicative of the discharge pressure of refrigerant rising or falling below a threshold pressure value. In another embodiment, the signal communicated by the switch 188 may be indicative of a value of the discharge pressure of refrigerant exiting the compressor 154. As used herein, the HVAC system 150 operates in the low ambient operating mode by maintaining the first valve 184 in the closed position to block refrigerant flow through the second set of tubes 164, and the HVAC system 150 operates in the normal operating mode by maintaining the first valve 184 in the open position to enable refrigerant flow through the second set of tubes 164.

The first valve 184 may be a solenoid valve configured to transition between the open position and the closed position based on an electrical signal transmitted to the first valve 184. In some embodiments, if the discharge pressure of the refrigerant exiting the compressor 154 is below a low pressure threshold, which may be a pressure value between, for example, 200 pounds per square inch gauge (psig) and 350 psig, the switch 188 may close and output the electrical signal indicative of the discharge pressure falling below the low pressure threshold. For example, the electrical signal may be a voltage signal between 10 volts and 50 volts. The electrical signal may be sent directly to the first valve 184 by the switch 188, and the electrical signal may cause the first valve 184 to close and block the flow of refrigerant through the second set of tubes 164. As a result of blocking the flow of refrigerant through the second set of tubes 164 of the condenser system 158, a total amount of heat transferred from the refrigerant to the ambient air flow via the condenser system 158 may be reduced. In the manner described above, this may result in the discharge pressure of the refrigerant exiting the compressor 154 to increase, such as increase above the low pressure threshold.

In order to transition operation of the HVAC system 150 from the low ambient operating mode to the normal operating mode, the discharge pressure of the refrigerant exiting the compressor 154 may first exceed a high threshold pressure. Generally, operating the HVAC system 150 in the normal operating mode enables greater cooling of the air flow in the evaporator 156 but also decreases the discharge pressure of the refrigerant exiting the compressor 154 relative to the discharge pressure of the refrigerant exiting the compressor 154 in the low ambient operating mode. Thus, to ensure that transition of the HVAC system 150 from the low ambient operating mode to the normal operating mode does not result in a decrease in the discharge pressure of the refrigerant exiting the compressor 154 below the low threshold pressure, the HVAC system 150 may be configured to operate in the low ambient operating mode until the discharge pressure of the refrigerant exiting the compressor 154 rises above a high pressure threshold that is greater than the low pressure threshold. For example, the high pressure threshold may be between 400 and 600 psig. When the discharge pressure of the refrigerant exiting the compressor 154 rises above the high pressure threshold, the switch 188 may open, thereby interrupting the electrical signal sent to the first valve 184. Once the first valve 184 no longer receives the electrical signal, the first valve 184 may open to enable flow of refrigerant through the second set of tubes 164 and transition operation of the HVAC system 150 to the normal operating mode.

In alternative embodiments, the first valve 184 may be configured to open upon receipt of the electrical signal to enable refrigerant to flow through the second inlet conduit 172 and the second set of tubes 164, and the first valve 184 may be configured to close when the electrical signal is not received to block refrigerant flow through the second inlet conduit 172 and the second set of tubes 164. In such embodiments, if the discharge pressure of the refrigerant exiting the compressor 154 is below the low threshold pressure, the switch 188 may open and block the electrical signal from being transmitted to the first valve 184 to close the first valve 184. If the discharge pressure of the refrigerant exiting the compressor 154 is above the high pressure threshold, the switch 188 may close and enable transmission of the electrical signal to the first valve 184 to open the first valve 184. Although this disclosure primarily discusses using the discharge pressure of the refrigerant exiting the compressor 154 to adjust the position of the first valve 184, in additional or alternative embodiments, another operating parameter, such as a discharge temperature of the refrigerant exiting the compressor 154, a temperature of the ambient air, a suction temperature or pressure of refrigerant entering the compressor 154, another suitable operating parameter, or any combination thereof, may be used to adjust the position of the first valve 184.

Remaining components of the HVAC system 150 may operate in the same mode during the low ambient operating mode of the HVAC system 150 as the normal operating mode of the HVAC system 150. For example, during the normal operating mode of the HVAC system 150, the one or more fans 160 and the compressor 154 may each be operated in an active operating mode. During the low ambient operating mode of the HVAC system 150, the one or more fans 160 and the compressor 154 may each continue to operate in the same active operating mode without impacting a desired performance, such as an efficiency, of the HVAC system 150. As such, the one or more fans 160 may be constant speed fans, rather than variable speed fans, configured to operate at a single operating speed or level to draw or direct air across the condenser system 158 at a constant flow rate. Similarly, the compressor 154 may be a single stage compressor, rather than a multi-stage compressor, configured to operate in a single operating stage to pressurize the refrigerant. Utilization of constant speed fans and/or a single stage compressor may simplify operation of the HVAC system 150 and reduce costs of producing and/or operating the HVAC system 150.

In some embodiments, the first valve 184 may be an on-off valve, whereby the first valve 184 may be configured to be in a fully open position or a fully closed position. As such, the first valve 184 may not be configured transition to an intermediate position between the fully open position and the fully closed position. That is, the first valve 184 may enable full refrigerant flow through the second inlet conduit 172 or block refrigerant flow through the second inlet conduit 172, but may not enable a flow rate of refrigerant between the full flow or the blocked flow. In alternative implementations, the first valve 184 may be configured to be between the fully open position and the fully closed position, such that the HVAC system 150 may operate in operating modes between the low ambient operating mode and the normal operating mode. In other words, the first valve 184 may enable a certain amount of refrigerant flow through the second inlet conduit 172, and therefore the second set of tubes 164, that is between the full refrigerant flow and the blocked refrigerant flow based on the position of the first valve 184.

The HVAC system 150 may further include a controller 190, such as the control board 47 and/or the control panel 82, configured to control operation of the HVAC system 150. In some embodiments, the controller 190 may be a part of the first valve 184 and/or the second valve 186. The controller 190 may include a memory 192 and a processor 194. The memory 192 may be a mass storage device, a flash memory device, removable memory, or any other non-transitory computer-readable medium that includes instructions for the processor 194 to execute. The memory 192 may also include volatile memory such as randomly accessible memory (RAM) and/or non-volatile memory such as hard disc memory, flash memory, and/or other suitable memory formats. The processor 194 may execute the instructions stored in the memory 192.

In certain embodiments, the controller 190 may be configured to instruct the first valve 184 to transition between the open position and the closed position. For instance, the controller 190 may be communicatively coupled to the switch 188 configured to determine or measure the discharge pressure of the refrigerant exiting the compressor 154. The switch 188 may transmit feedback to the controller 190 indicative of the discharge pressure, and the controller 190 may adjust the first valve 184 based on the transmitted feedback. In one example, the switch 188 may be a sensor configured to determine a discharge pressure value of refrigerant exiting the compressor 154 and send feedback indicative of the discharge pressure value to the controller 190. The controller 190 may compare the discharge pressure value received from the switch 188 with a low pressure threshold value and a high pressure threshold value and adjust the position of the first valve 184 based on the comparison. For instance, the controller 190 may instruct the first valve 184 to close in response to a determination that the discharge pressure value is below the low pressure threshold value and may instruct the first valve 184 to open in response to a determination that the discharge pressure value is above the high pressure threshold value. In another example, the controller 190 may determine a position of the switch 188 and may adjust the position of the first valve 184 based on the determined position of the switch 188. In some embodiments, the controller 190 may determine if the switch 188 is in the open position, indicating the discharge pressure is below the low pressure threshold, and may instruct the first valve 184 to close in response. Additionally, if the controller 190 determines the switch 188 is in the closed position, indicating the discharge pressure is above the high pressure threshold, the controller 190 may instruct the first valve 184 to open in response.

As mentioned above, in some embodiments, the second valve 186 may be a check valve configured to enable the refrigerant to flow in one direction through the second outlet conduit 178. For example, the second valve 186 may enable the refrigerant to flow out of the second set of tubes 164 via the second outlet conduit 178, but may block refrigerant from flowing into the second set of tubes 164 via the second outlet conduit 178. In additional or alternative embodiments, the second valve 186 may be an on-off valve, in which the position of the second valve 186 may be adjusted between an open position and a closed position to control a flow of refrigerant through the second outlet conduit 178. In such embodiments, the second valve 186 may be communicatively coupled to the switch 188 and/or the controller 190 to instruct the second valve 186 to transition between the open position and the closed position, such as based on the discharge pressure of refrigerant exiting the compressor 154.

Although this disclosure primarily discusses directing the refrigerant to different sections of the condenser system 158, in additional or alternative embodiments, the disclosed techniques may be utilized to control refrigerant flow through different sections of the evaporator 156. That is, the refrigerant may be controlled to flow through selected tubes of the evaporator 156 based on an operation of the HVAC system 150 and/or based on operating conditions, such as ambient air temperature, of the HVAC system 150. In further embodiments, the HVAC system 150 may be a heat pump and may be configured to operate in a certain configuration in which the condenser system 158 is configured to transfer heat from ambient air to the refrigerant, and the evaporator 156 is configured to transfer heat from the refrigerant to the supply air flow. In such embodiments, the condenser system 158 may operate to heat the refrigerant, and the refrigerant may be controlled to flow through different sections of the condenser system 158 based on a desired operation of the HVAC system 150 to heat the air flow.

Figure 6:
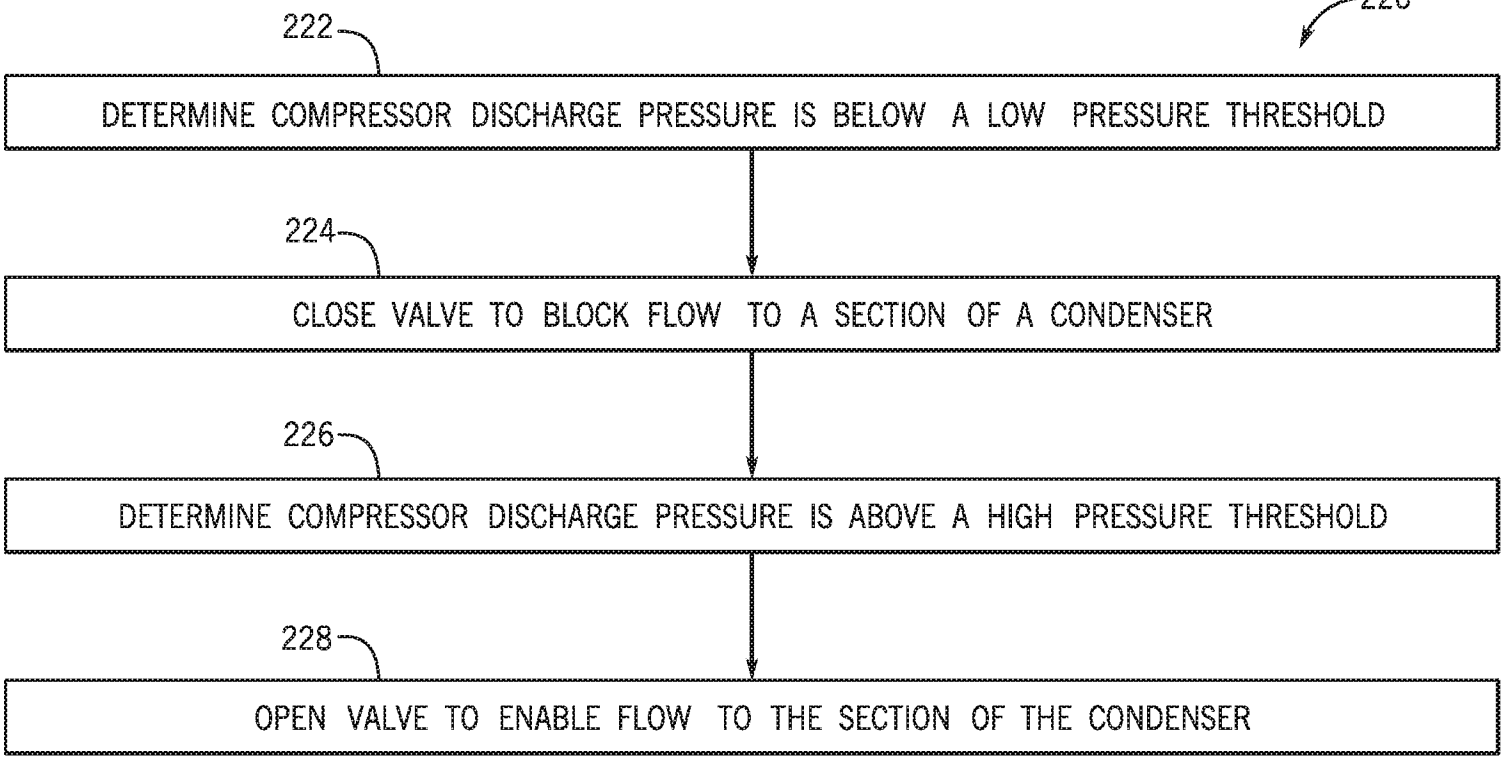
FIG. 6 is a block diagram of an embodiment of a method that may be used to control operation of the HVAC system of FIG. 5, in accordance with an aspect of the present disclosure.

FIG. 6 illustrates a block diagram of an embodiment of a method or process 220 that may be used to control an operation of the HVAC system 150, in accordance with the present techniques. For example, the method 220 may be performed by the controller 190 that is configured to control operation of the first valve 184, or the method 220 may be performed by the first conduit system 166 and its associated components without the controller 190. In additional or alternative embodiments, other steps may be performed in addition to the method 220, or certain steps of the depicted method 200 may be modified, removed, or performed in a different order than shown in the embodiment of FIG. 6. Furthermore, although FIG. 6 is described with reference to the HVAC system 150 of FIG. 5, a method or process similar to the method 220 may additionally or alternatively be performed in other embodiments of the HVAC system 150, such as embodiments having a different arrangement or configuration of certain components.

At block 222, the compressor discharge pressure is determined to be below a low pressure threshold. In one implementation, a position of the switch 188 indicates whether the compressor discharge pressure is above or below the low pressure threshold. For example, a low compressor discharge pressure may physically or electrically cause the switch 188 to open. In other words, the switch 188 may open without the determination of an exact value of the compressor discharge pressure. In another implementation, a measured value of the compressor discharge pressure may be determined by the switch 188, and the value may be compared to the low pressure threshold, such as by the controller 190. Based on the comparison, the controller 190 may determine if the compressor discharge pressure is below the low pressure threshold.

At block 224, in response to a determination that the compressor discharge pressure is below the low pressure threshold, the first valve 184 closes, and the HVAC system 150 operates in the low ambient operating mode. As a result, the flow of refrigerant to a section of the condenser system 158, such as to the second set of tubes 164, is blocked. In this manner, the cooling of the refrigerant in the condenser system 158 may be reduced, and the compressor discharge pressure may correspondingly increase above the low pressure threshold.

At block 226, the compressor discharge pressure is determined to be above a high pressure threshold. That is, the detection of compressor discharge pressure above the high pressure threshold may physically or electrically open the switch 188, or the switch 188 may determine a value of the compressor discharge pressure to be compared to the high pressure threshold value. The position of the switch 188 and the comparison between the compressor discharge pressure value and the high pressure threshold value may each indicate whether the compressor discharge pressure is above the high pressure threshold.

In response to a determination that the compressor discharge pressure is above the high pressure threshold, the first valve 184 opens, as shown at block 228, and the HVAC system 150 proceeds to operate in the normal operating mode. Thus, the refrigerant may flow to a greater portion of the condenser system 158, such as to both the first set of tubes 162 and the second set of tubes 164. As a result, the refrigerant may be cooled a greater amount in the condenser system 158, and the refrigerant may also have an increased capacity to remove heat from the air flow in the evaporator 156.

Figure 7:
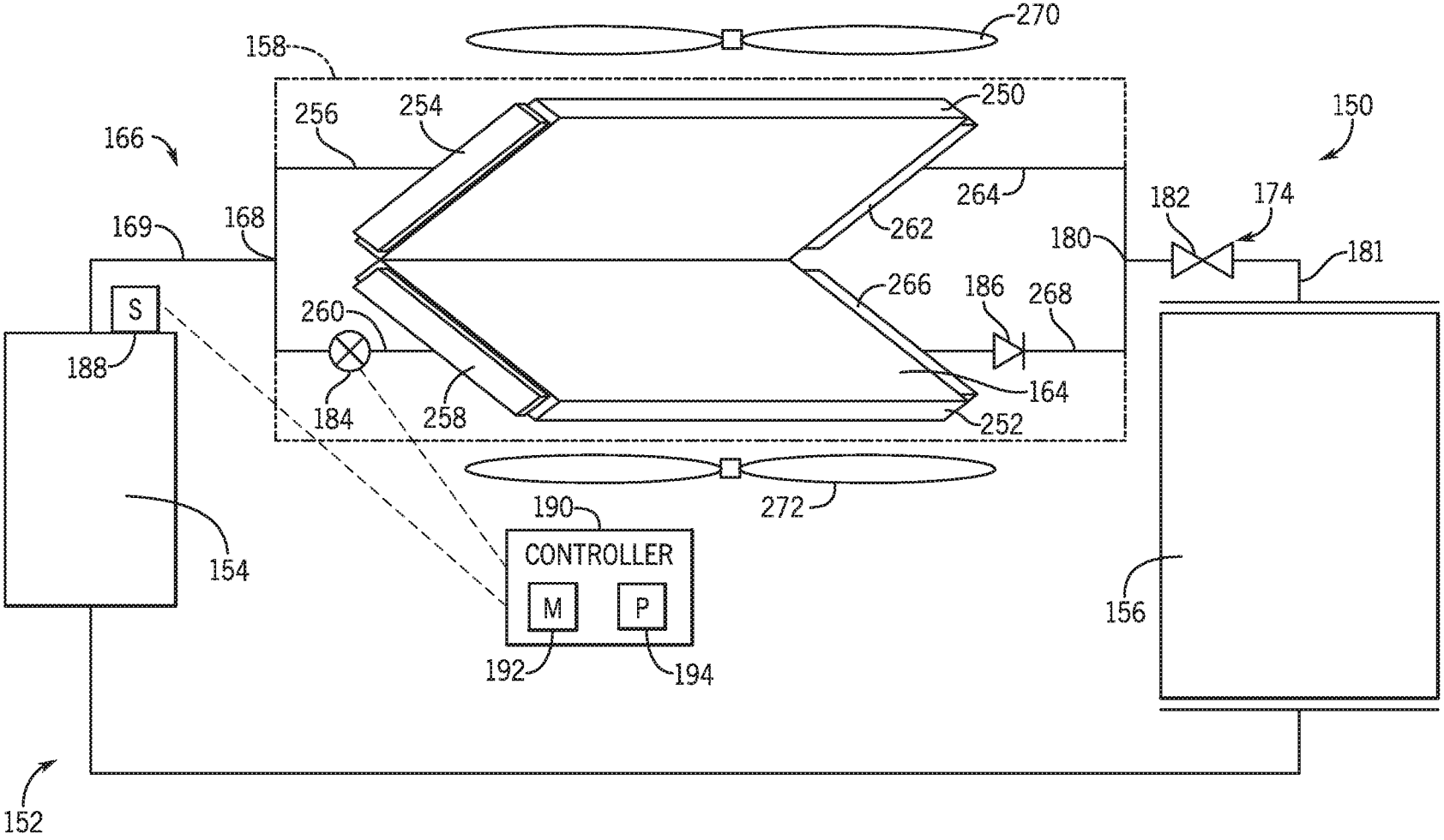
FIG. 7 is a schematic view of another embodiment of an HVAC system, illustrating a heat exchanger having a first slab and a second slab, in accordance with an aspect of the present disclosure.

FIG. 7 is a schematic view of another embodiment of the HVAC system 150, in which the HVAC system 150 includes a first slab 250 and a second slab 252. More specifically, the condenser system 158 of the illustrated embodiment includes the first slab 250 and the second slab 252, where the first slab 250 and the second slab 252 each includes a set of tubes that are fluidly separate from one another. In the illustrated embodiment, the first slab 250 and the second slab 252 are disposed at an angle relative to one another to form a V-shape configuration. The illustrated embodiment also includes the first conduit system 166 and the second conduit system 174 having configurations that are similar to those described above with reference to FIG. 5.

The first conduit system 166 is configured to direct a first portion of refrigerant from the compressor 154 to a first inlet 254 or manifold of the first slab 250 via a first inlet conduit 256 and is also configured to direct a second portion of refrigerant from the compressor 154 to a second inlet 258 or manifold of the second slab 252 via a second inlet conduit 260. The second conduit system 174 may direct the first portion of refrigerant from a first outlet 262 or manifold of the first slab 250 to the evaporator 156 via a first outlet conduit 264 and may also direct the second portion of refrigerant from a second outlet 266 or conduit of the second slab 252 to the evaporator 156 via a second outlet conduit 268. The first valve 184 is disposed along the second inlet conduit 260 to regulate a flow of refrigerant through the second slab 252. Additionally, the second valve 186 is disposed on the second outlet conduit 268 to enable the refrigerant to flow out of the second slab 252 via the second outlet 266 and also to block the refrigerant from flowing into the second slab 252 via the second outlet 266. As such, in the embodiment of the HVAC system 150 of FIG. 7, the flow of refrigerant may be controlled to flow through the first slab 250 or through both of the slabs 250, 252. In alternative embodiments, the HVAC system 150 may include more than two slabs 250, 252, and the flow of refrigerant may be controlled to flow through any combination of such slabs, in accordance with the present techniques.

In the illustrated embodiment, the HVAC system 150 includes a first fan 270 configured to draw or force air across the first slab 250 and a second fan 272 configured to draw or force air across the second slab 252. As similarly discussed above, the first fan 270 and/or the second fan 272 may be constant speed fans. The operation of the first fan 270 and/or the second fan 272 may be controlled based on an operation of the HVAC system 150. For example, during the low ambient operating mode, in which the first valve 184 is closed such that refrigerant may not flow through the second slab 252, the operation of the second fan 272 may be disabled or suspended to reduce the consumption of energy. The first fan 270, on the other hand, may be configured to continuously operate during operation of the HVAC system 150, as the HVAC system 150 is configured to direct refrigerant through the first slab 250 during the normal operating mode and the low ambient operating mode. Operation of additional fans may be similarly controlled, in accordance with the present techniques.

Figure 8:
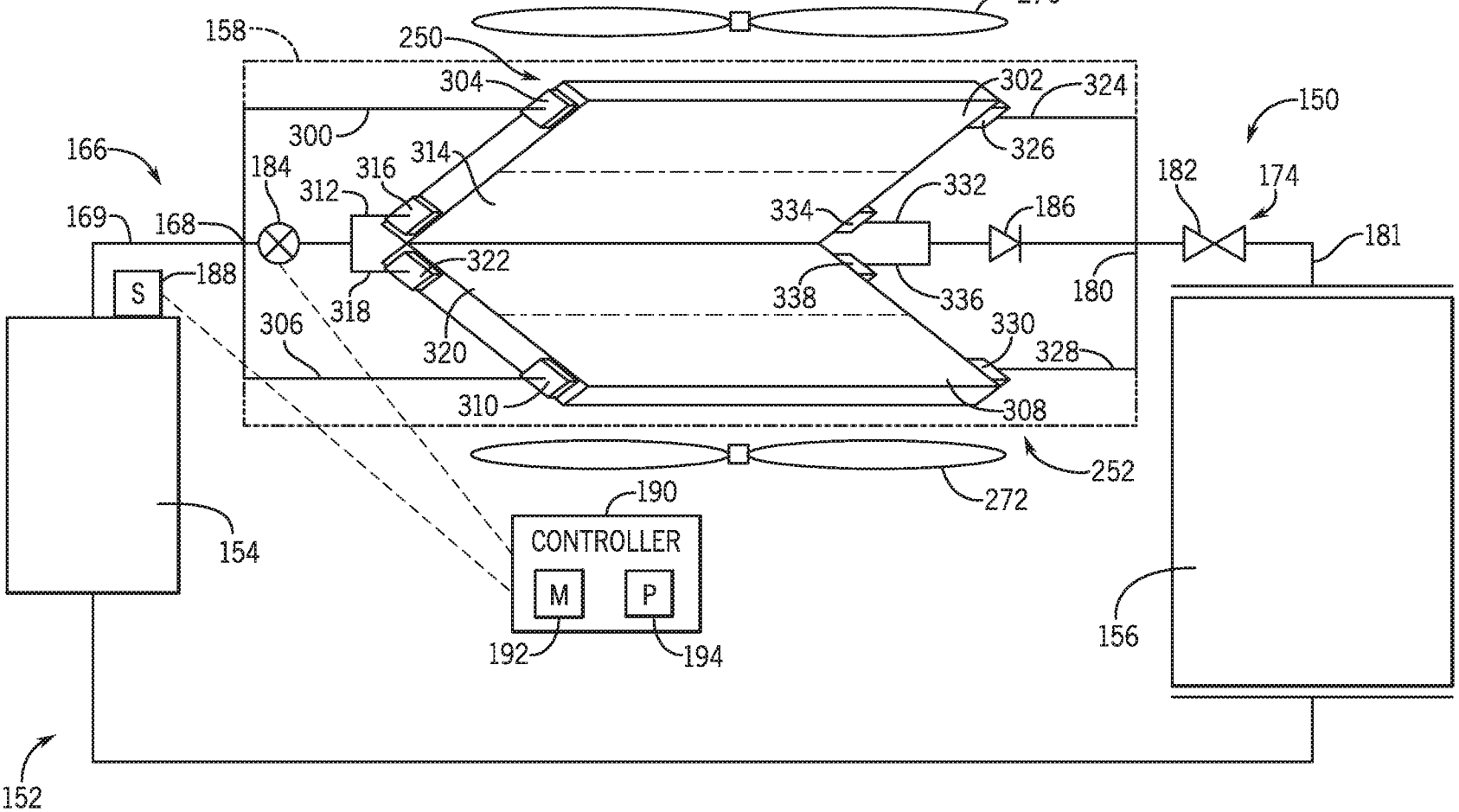
FIG. 8 is a perspective view of another embodiment of an HVAC system, illustrating a heat exchanger having a first slab and a second slab, in accordance with an aspect of the present disclosure.

FIG. 8 is a perspective view of another embodiment of the HVAC system 150 having the first slab 250 and the second slab 252. In the illustrated implementation, the first conduit system 166 includes a first inlet conduit 300 configured to direct refrigerant into a first section 302, such as a top portion, of the first slab 250 via a first inlet 304 or manifold and also includes a second inlet conduit 306 configured to direct refrigerant to a first section 308, such as a top portion, of the second slab 252 via a second inlet 310 or manifold. The first inlet 304 is configured to direct refrigerant to a set of tubes associated with the first section 302 of the first slab 250, and the second inlet 310 is configured to direct refrigerant to a set of tubes associated with the first section 308 of the second slab 252.

Additionally, the first conduit system 166 includes a third inlet conduit 312 configured to direct refrigerant to a second section 314, such as a bottom portion, of the first slab 250 via a third inlet 316 or manifold and also includes a fourth inlet conduit 318 configured to direct refrigerant to a second section 320, such as a bottom portion, of the second slab 252 via a fourth inlet 322 or manifold. The third inlet 316 is configured to direct refrigerant to a set of tubes associated with the second section 314 of the first slab 250, and the fourth inlet 322 is configured to direct refrigerant to a set of tubes associated with the second section 320 of the second slab 252.

The second conduit system 174 includes a first outlet conduit 324 configured to direct refrigerant out of the first section 302 of the first slab 250 via a first outlet 326 or manifold and includes a second outlet conduit 328 configured to direct refrigerant out of the first section 308 of the second slab 252 via a second outlet 330 or manifold. The second conduit system 174 also includes a third outlet conduit 332 configured to direct refrigerant out of the second section 314 of the first slab 250 via a third outlet 334 or manifold and includes a fourth outlet conduit 336 configured to direct refrigerant out of the second section 320 of the second slab 252 via a fourth outlet 338 or manifold.

The tubes of the first slab 250 may be fluidly separate from the tubes of the second slab 252 within the condenser system 158. Further, the tubes of each first section 304, 308 may be arranged in a split configuration with the tubes of respective second sections 314, 320 of the respective slab 205, 252, such that the first sections 304, 308 are fluidly separate from the respective second sections 314, 320 within the respective slabs 250, 252. Thus, the flow of refrigerant may be controlled to individually direct the refrigerant through certain sections 302, 308, 314, 320 of the slabs 250, 252. In some embodiments, the tubes in the first sections 304, 308 may be intertwined with the tubes in the respective second sections 314, 320 of the respective slabs 250, 252. In the illustrated implementation, the first valve 184 is positioned to regulate the flow of refrigerant through the third inlet conduit 312 and the fourth inlet conduit 318. Furthermore, the second valve 186 is positioned to enable the refrigerant to flow out of the first and second slabs 250, 252 through the third outlet conduit 332 and the fourth outlet conduit 336, respectively. However, the second valve 186 blocks refrigerant from flowing into the first and second slabs 250, 252 through the third outlet conduit 332 and the fourth outlet conduit 336. As previously discussed, the first valve 184 may be considered a component of the first conduit system 166, the condenser system 158, or both, and the second valve 186 may be considered a component of the second conduit system 174, the condenser system 158, or both.

If the first valve 184 is closed, refrigerant may not flow through the respective second sections 314, 320 of the first and second slabs 250, 252, but refrigerant may flow through the respective first sections 302, 308 of the first and second slabs 250, 252. In alternative embodiments, the refrigerant flow may be directed through other combinations of the sections 302, 308, 314, 320 of the first and/or second slabs 250, 252. By way of example, the first valve 184 may be positioned along appropriate conduits in order to regulate refrigerant flow through the first section 308 of the second slab 252, the second section 314 of the first slab 250, and the second section 320 of the second slab 252. As such, in the low ambient operating mode, when the first valve 184 is closed, the refrigerant may flow through first section 302 of the first slab 250, but not through other sections 308, 314, 320 of the condenser system 158, in order to reduce heat transfer from the refrigerant to the ambient air and effectuate an increase in compressor discharge pressure.

Embodiments of the present disclosure may provide one or more technical effects useful in the operation of HVAC systems. For example, the HVAC system may be configured to operate in different operating modes, in which a refrigerant is directed through different sections of a heat exchanger in the different operating modes, where the heat exchanger places the refrigerant in a heat exchange relationship with an ambient air flow. In some embodiments, the HVAC system includes a valve configured to block a flow of refrigerant to a particular section of the heat exchanger, depending on the operating mode of the HVAC system. Based on a detected compressor discharge pressure of the HVAC system, or based on other suitable operating parameters, the valve may be in an open position or a closed position. For example, when the compressor discharge pressure of the HVAC system is above a high pressure threshold, the HVAC system may operate in a normal operating mode, in which the valve is in the open position, and refrigerant may flow through the valve and through all sections of the heat exchanger.

When the compressor discharge pressure is below a low pressure threshold, such as during times of low ambient temperatures, the HVAC system may operate in a low ambient operating mode, in which the valve is in the closed position, and refrigerant is blocked from flowing through the valve and through the particular section of the heat exchanger, while refrigerant is permitted to flow through other sections of the heat exchanger. Reducing the available heat exchanger sections through which the refrigerant may flow may change an amount of heat transferred between the refrigerant and the ambient air flow to effectuate an increase in the compressor discharge pressure above the low pressure threshold. In this way, performance of the HVAC system may be improved, while also reducing manufacturing and/or operating costs of the HVAC system. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A heating, ventilation, and/or air conditioning (HVAC) system, comprising:

a refrigerant circuit including a compressor, a condenser system having a first set of tubes and a second set of tubes fluidly separate from the first set of tubes within the condenser system, and a valve positioned downstream of the compressor and upstream of the second set of tubes relative to a direction of refrigerant flow through the refrigerant circuit, wherein the refrigerant circuit is configured to direct refrigerant through the first set of tubes and through the second set of tubes; and a switch configured to open and close to control transmission of an electrical signal to the valve based on an operating parameter of the HVAC system, wherein the switch is configured to close and transmit the electrical signal to the valve to open the valve and enable refrigerant flow through the second set of tubes and through the first set of tubes when a value of the operating parameter exceeds a threshold, and wherein the switch is configured to open and interrupt transmission of the electrical signal to the valve to close the valve, such that refrigerant flow is blocked through the second set of tubes and refrigerant flow is enabled through the first set of tubes, when the value of the operating parameter is below the threshold.

2. The HVAC system of claim 1, comprising a fan configured to force air flow across the condenser system, wherein the fan is a constant speed fan.

3. The HVAC system of claim 2, wherein the fan is a first fan configured to force air flow across the first set of tubes, and wherein the HVAC system includes a second fan configured to force air flow across the second set of tubes, wherein the HVAC system is configured to suspend operation of the second fan when the valve is closed.

4. The HVAC system of claim 1, wherein the condenser system includes a coil slab having the first set of tubes and the second set of tubes.

5. The HVAC system of claim 1, comprising a check valve positioned within the condenser system and downstream of the second set of tubes relative to the direction of refrigerant flow through the refrigerant circuit.

6. The HVAC system of claim 1, wherein the refrigerant circuit includes an evaporator configured to receive refrigerant flow from the first set of tubes and the second set of tubes.

7. The HVAC system of claim 1, wherein the compressor is a single-stage compressor.

8. The HVAC system of claim 1, wherein the operating parameter is a discharge pressure of the compressor, a temperature of ambient air, a pressure of the refrigerant, a temperature of the refrigerant, or any combination thereof.

9. A heating, ventilation, and/or air conditioning (HVAC) system, comprising:

a condenser system having a first set of tubes and a second set of tubes, wherein the first set of tubes and the second set of tubes are each configured to receive refrigerant;

a valve positioned within the condenser system and upstream of the second set of tubes relative to a direction of refrigerant flow through the second set of tubes; and a switch communicatively coupled to the valve and configured to transition between open and closed positions based on an operating parameter of the HVAC system, wherein, in the closed position, the switch is configured to transmit an electrical signal to the valve to close the valve such that refrigerant flow is blocked through the second set of tubes and enabled through the first set of tubes.

10. The HVAC system of claim 9, comprising a constant speed fan configured to force air flow across the first set of tubes and the second set of tubes.

11. The HVAC system of claim 9, wherein the valve is an on-off valve.

12. The HVAC system of claim 11, comprising a check valve positioned within the condenser system and downstream of the second set of tubes relative to the direction of refrigerant flow through the second set of tubes.

13. The HVAC system of claim 9, wherein the first set of tubes has a first number of tubes, the second set of tubes has a second number of tubes, and the first number of tubes is greater than the second number of tubes.

14. The HVAC system of claim 13, wherein the first set of tubes includes approximately two-thirds of a total number of tubes in the condenser system, and the second set of tubes includes approximately one-third of the total number of tubes in the condenser system.

15. The HVAC system of claim 9, wherein the first set of tubes and the second set of tubes have a split arrangement in a slab of the condenser system.

16. The HVAC system of claim 9, wherein the valve is a solenoid valve configured to close in response to receiving the electrical signal, and the switch is configured to transition to the closed position to transmit the electrical signal to the solenoid valve based on the operating parameter being below a threshold value.

17. A heating, ventilation, and/or air conditioning (HVAC) system, comprising:

a condenser system having a first set of tubes and a second set of tubes, wherein the first set of tubes and the second set of tubes are each configured to receive refrigerant;

a compressor configured to direct refrigerant to the condenser system;

a switch attached to the compressor and configured to detect an operating parameter of the HVAC system, wherein the switch is configured to control output of a signal based on the operating parameter; and a valve positioned upstream of the second set of tubes relative to a direction of refrigerant flow through the second set of tubes, wherein the valve is configured to transition from an open position to a closed position based on receipt of the signal output by the switch, wherein refrigerant flow is blocked through the second set of tubes and enabled through the first set of tubes when the valve is in the closed position.

18. The HVAC system of claim 17, wherein the operating parameter is a compressor discharge pressure of the refrigerant directed to the condenser system.

19. The HVAC system of claim 18, wherein the switch is configured to close and output the signal based on the compressor discharge pressure being below a threshold pressure.

20. The HVAC system of claim 19, wherein the threshold pressure is a low pressure threshold, and wherein the switch is configured to open and interrupt output of the signal based on the compressor discharge pressure being above a high pressure threshold greater than the low pressure threshold, wherein the valve is configured to transition to the open position based on an interruption in receiving the signal.

21. The HVAC system of claim 17, comprising a check valve positioned downstream of the second set of tubes relative to the direction of refrigerant flow through the second set of tubes, wherein the check valve is configured to enable refrigerant flow from the second set of tubes toward an evaporator of the HVAC system and block refrigerant flow from the evaporator toward the second set of tubes.

22. The HVAC system of claim 17, wherein the condenser system includes a first slab having a first subset of the first set of tubes and a first subset of the second set of tubes, and wherein the condenser system includes a second slab having a second subset of the first set of tubes and a second subset of the second set of tubes.

23. The HVAC system of claim 22, wherein the first slab and the second slab are arranged in a V-shape configuration.

24. The HVAC system of claim 17, wherein the switch comprises a pressure switch configured to open and close to control the output of the signal independently of a controller separate from the switch.

25. The HVAC system of claim 17, wherein the switch is positioned within the compressor.

* * * * *